US006439938B1

(12) United States Patent
Katayama

(10) Patent No.: US 6,439,938 B1
(45) Date of Patent: Aug. 27, 2002

(54) COWLING ARRANGEMENT FOR OUTBOARD MOTOR

(75) Inventor: Goichi Katayama, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/870,802

(22) Filed: May 31, 2001

(30) Foreign Application Priority Data

May 31, 2000 (JP) ..... 2000-163107

(51) Int. Cl.[7] ..... B65H 21/38
(52) U.S. Cl. ..... 440/88; 440/77
(58) Field of Search ..... 440/77, 88

(56) References Cited

U.S. PATENT DOCUMENTS

| | | | |
|---|---|---|---|
| 5,184,578 | A | 2/1993 | Quinn, Jr. et al. |
| 5,289,805 | A | 3/1994 | Quinn, Jr. et al. |
| 5,460,130 | A | 10/1995 | Fukuzawa et al. |
| 5,489,227 | A | 2/1996 | Ishida et al. |
| 5,592,207 | A | 1/1997 | Hasebe et al. |
| 5,704,315 | A | 1/1998 | Tsuchida et al. |
| 5,718,196 | A | 2/1998 | Uchiyama et al. |
| 5,722,356 | A | 3/1998 | Hara |
| 5,743,228 | A | 4/1998 | Takahashi |
| 5,816,204 | A | 10/1998 | Moriya et al. |
| 5,899,778 | A | 5/1999 | Hiraoka et al. |
| 5,924,396 | A | 7/1999 | Ochiai et al. |
| 5,928,043 | A | 7/1999 | Rinzaki |
| 6,032,629 | A | 3/2000 | Uchida |
| 6,035,817 | A | 3/2000 | Uchida |
| 6,076,492 | A | 6/2000 | Takahashi |
| 6,099,371 | A | 8/2000 | Nozawa et al. |
| 6,129,060 | A | 10/2000 | Koda |
| 6,186,104 | B1 | 2/2001 | Torii et al. |

FOREIGN PATENT DOCUMENTS

| | | | |
|---|---|---|---|
| DE | 3613945 | A1 | 10/1986 |
| EP | 0 452 671 | A2 | 10/1991 |
| EP | 0 583 584 | A1 | 2/1994 |
| EP | 0 834 647 | A1 | 4/1998 |

OTHER PUBLICATIONS

Copending Patent Application; Ser. No. 09/299,537, filed Apr. 26, 1999, Entitled Cowling Arrangement for Outboard Motor, in the names of Atsushi Isogawa et al., assigned to Sanshin Kogyo Kabushiki Kaisha.

*Primary Examiner*—Sherman Basinger
(74) *Attorney, Agent, or Firm*—Knobbe, Martens, Olson & Bear, LLP.

(57) ABSTRACT

An outboard motor includes a cowling substantially enclosing a four-cycle engine therein. The engine has an air induction device for introducing air to a combustion chamber, and an exhaust system for communicating exhaust products away from the combustion chamber. A pair of camshafts actuate intake and exhaust valves. A variable valve timing (VVT) mechanism is arranged at an upper end of at least one of the camshafts to set the camshaft to an angular position between advanced and delayed angular positions. The cowling includes an air intake, and an engine cover is positioned between the engine and the air intake. The engine cover covers the top and sides of the VVT mechanism so as to protect the VVT mechanism from contact with water that may enter the cowling through the air intake.

16 Claims, 9 Drawing Sheets

COWLING ARRANGEMENT FOR OUTBOARD MOTOR

PRIORITY INFORMATION

This application is based on and claims priority to Japanese Patent Application No. 2000-163107, filed May 31, 2000, the entire contents of which are hereby expressly incorporated by reference.

BACKGROUND OF THE INVENTION

1. Field of the Invention

This invention relates to a cowling arrangement for an outboard motor, and more particularly to a cowling arrangement for an outboard motor having a four-cycle engine that includes a variable valve timing mechanism.

2. Description of Related Art

Outboard motors are often powered by internal combustion engines. The engine is typically positioned within an enclosed cowling. The engine is generally vertically arranged, so that a crankshaft thereof may extend downwardly in driving relation with a water propulsion device of the motor, such as a propeller. In order to balance the motor and because of space considerations, the engine is arranged with a crankcase of the engine facing in the direction of a watercraft to which the motor is mounted (i.e., positioned on a front side of the engine), and with the cylinder head positioned on an end of the engine facing away from the watercraft (i.e., positioned on a rear side of the engine).

Air must be supplied to the engine through the cowling for combustion. Conventionally, the cowling is divided into an engine compartment and an air guide chamber, with an air vent in the cowling communicating with the air guide chamber. Outside air is supplied to the engine through the air vent and air guide chamber. In order to prevent the direct entry of water through the air vent into the intake system, the air vent is positioned away from the intake system, typically in the end of the engine facing away from the watercraft.

When water splashes into the air vent, it can flow through the air guide chamber and into the cowling, possibly depositing on engine components. This can result in malfunction of and/or damage to the affected components. In addition, during watercraft turns, any water that pools on the flywheel cover can often drain onto engine components, leading to similar consequences.

Four-cycle internal combustion engines tend to have advantageous emission control and high performance relative to two-cycle internal combustion engines. Accordingly, it is becoming popular for outboard motors to employ such four-cycle internal combustion engines. Typically, the four-cycle engine has intake and exhaust ports, both of which communicate with a combustion chamber. One or more camshafts are often provided to actuate the intake and exhaust valves between an open position and a closed position so that air is introduced into the combustion chamber and exhaust gases are discharged therefrom at proper timing.

Automobile engines often include a variable valve timing mechanism that can advantageously change the opening and closing timing of the valves depending on certain operating conditions, such as engine speed. The intake valve timing usually is advanced at high engine speeds to ensure high charging efficiency and high performance. Intake valve timing usually is delayed at low engine speeds to ensure high combustion efficiency, fuel economy and good emission control.

Sometimes, the variable valve timing mechanism is mounted at the upper end of at least the intake camshaft. This arrangement makes the variable valve timing mechanism especially vulnerable to fouling by water that may enter the cowling through the intake ducts.

A need therefore exists for an improved water preclusion arrangement for an outboard motor having a four-cycle engine with a variable valve timing mechanism, which arrangement provides improved protection of the variable valve timing mechanism from water.

SUMMARY OF THE INVENTION

In accordance with one aspect, the present invention provides an outboard motor comprising a cowling and a four-cycle internal combustion engine positioned within the cowling. The cowling has an air intake duct configured to introduce air into the cowling from the environment outside of the cowling. The engine is adapted to drive a substantially vertically oriented crankshaft. The engine comprises a combustion chamber, an induction system configured to supply intake air to the combustion chamber, and an exhaust system configured to conduct combustion products away from the combustion chamber. The induction system is arranged generally on one of a first side of the engine and a second side of the engine, and the exhaust system is arranged generally on the other of the first side and second side of the engine. A camshaft is driven by the crankshaft. A variable valve timing mechanism cooperates with the camshaft and is positioned at an upper end of the camshaft. An engine cover is positioned between an upper end of the engine and the air intake duct. The engine cover has a first upwardly-extending rib positioned between the air intake duct and the first side of the engine, a second upwardly-extending rib positioned between the air intake and a front side of the engine, and an upwardly-extending portion positioned generally above the variable valve timing mechanism. The ribs and upwardly-extending portion are configured to direct air from the air intake duct toward the second side of the engine and away from the variable valve timing mechanism. The air intake duct is positioned offset toward the second side of the engine and generally forwardly of the upwardly-extending portion of the engine cover.

In accordance with another aspect of the present invention, an outboard motor comprises a cowling having an air intake duct configured to introduce air into the cowling from the environment outside of the cowling, and a four-cycle internal combustion engine positioned within the cowling and adapted to drive a substantially vertically oriented crankshaft. A camshaft is arranged generally parallel to the crankshaft. A variable valve timing (VVT) mechanism is configured to selectively vary a phase angle of the camshaft. The VVT mechanism is arranged adjacent an upper end of the camshaft and comprises a setting section, a fluid supply section, and a control section. A cover is arranged between the engine and the air intake. The cover comprises a top portion and a side wall depending from the top portion and having a lower edge. The top portion covers the VVT mechanism, and a portion of the side wall adjacent the VVT mechanism is configured so that the lower edge is at or below a lowermost portion of the VVT mechanism.

In accordance with yet another aspect, the present invention provides an outboard motor comprising a cowling and a four-cycle internal combustion engine positioned within the cowling. The cowling has an air intake duct configured to introduce air into the cowling from the environment outside of the cowling. The engine is adapted to drive a substantially vertically oriented crankshaft. A camshaft is arranged generally parallel to the crankshaft and is driven by the crankshaft. A variable valve timing (VVT) mechanism is configured to selectively vary a phase angle of the camshaft, and is arranged adjacent an upper end of the camshaft. A cover is arranged between the engine and the air intake. The cover comprises a top portion and a side wall depending from the top portion. The air intake duct is positioned on an opposite side of a longitudinal center line of the cowling from the VVT mechanism.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise 9 figures.

DETAILED DESCRIPTION OF THE PREFERRED EMBODIMENTS OF THE INVENTION

Figure 1:
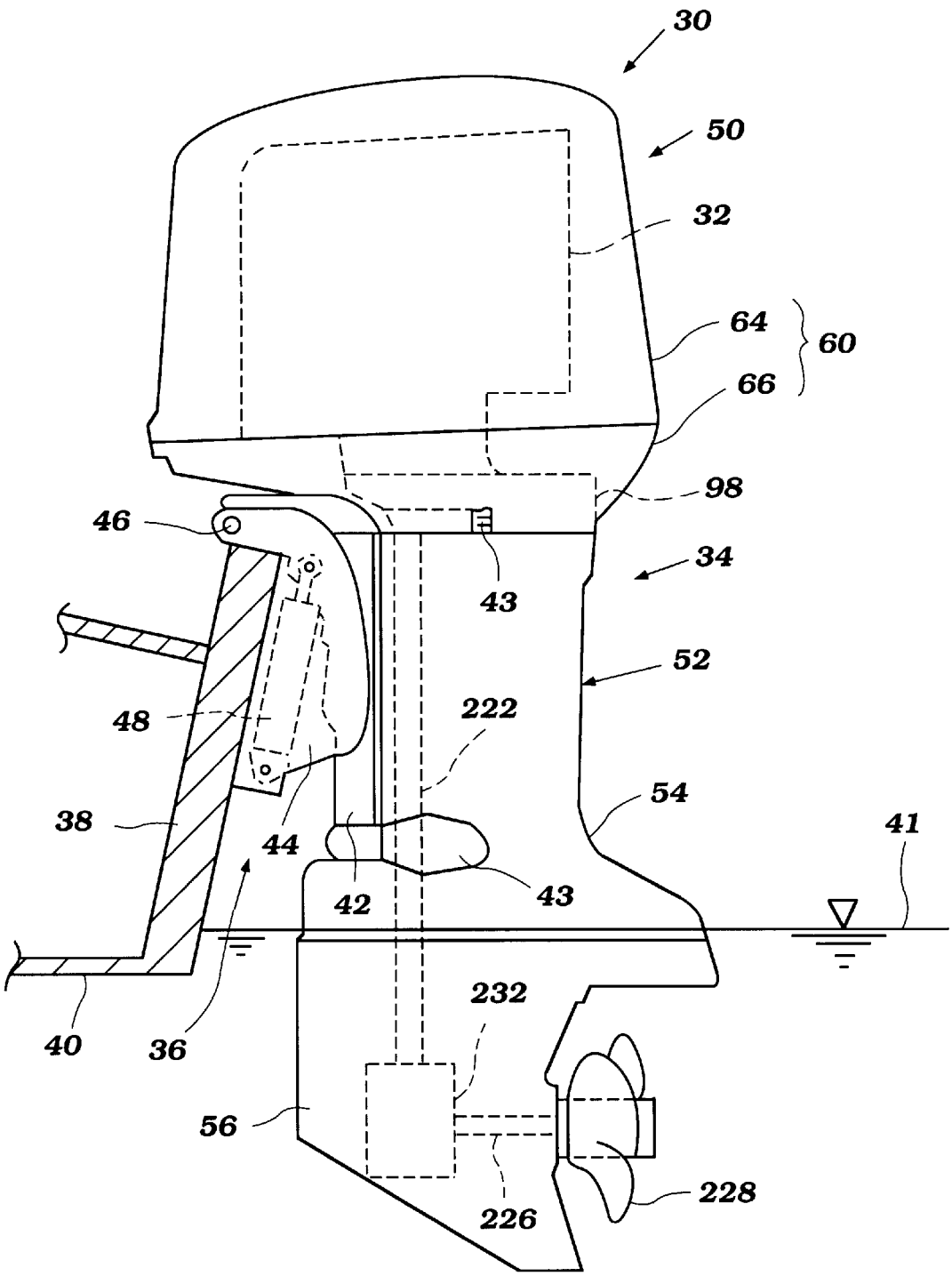
FIG. 1 is a side elevational view of an outboard motor configured in accordance with a preferred embodiment of the present cowling arrangement.

With reference to FIGS. 1–7, an overall construction of an outboard motor 30 that employs an internal combustion engine 32 configured in accordance with certain features, aspects and advantages of the present invention will be described. The engine has particular utility in the context of a marine drive such as an outboard motor, and thus is described in the context of an outboard motor. The engine, however, can be used with other types of marine drives and also land vehicles, and further can be used as a stationary engine.

In the illustrated arrangement, the outboard motor 30 comprises a drive unit 34 and a bracket assembly 36. The bracket assembly 36 supports the drive unit 34 on a transom 38 of an associated watercraft 40 and places a marine propulsion device in a submerged position when the watercraft 40 is resting on the surface 41 of a body of water. The bracket assembly 36 preferably comprises a swivel bracket 42, a clamping bracket 44, a steering shaft and a pivot pin 46.

The steering shaft typically extends through the swivel bracket 42 and is affixed to the drive unit 34 by top and bottom mount assemblies 43. The steering shaft is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 46 completes a hinge coupling between the swivel bracket 42 and the clamping bracket 44. The pivot pin 46 extends through the bracket arms so that the clamping bracket 44 supports the swivel bracket 42 for pivotal movement about a generally horizontally extending tilt axis defined by the pivot pin 46. The drive unit 34 thus can be tilted or trimmed about the pivot pin 46.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system 48 preferably is provided between the swivel bracket 42 and the clamping bracket 44 for tilt movement (raising or lowering) of the swivel bracket 42 and the drive unit 34 relative to the clamping bracket 44. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 50 and a housing unit 52 which includes a driveshaft housing 54 and a lower unit 56. The power head 50 is disposed atop the drive unit 34 and includes an internal combustion engine 32 that is positioned within a protective cowling 60 that preferably is made of plastic. Preferably, the protective cowling 60 defines a generally enclosed cavity 62 in which the engine 32 is disposed. The protective cowling assembly 60 preferably comprises a top cowling member 64 and a bottom cowling member 66. The top cowling member 64 preferably is detachably affixed to the bottom cowling member 66 by a coupling mechanism so that a user, operator, mechanic or repair person can access the engine 32 for maintenance or for other purposes.

Figure 5:
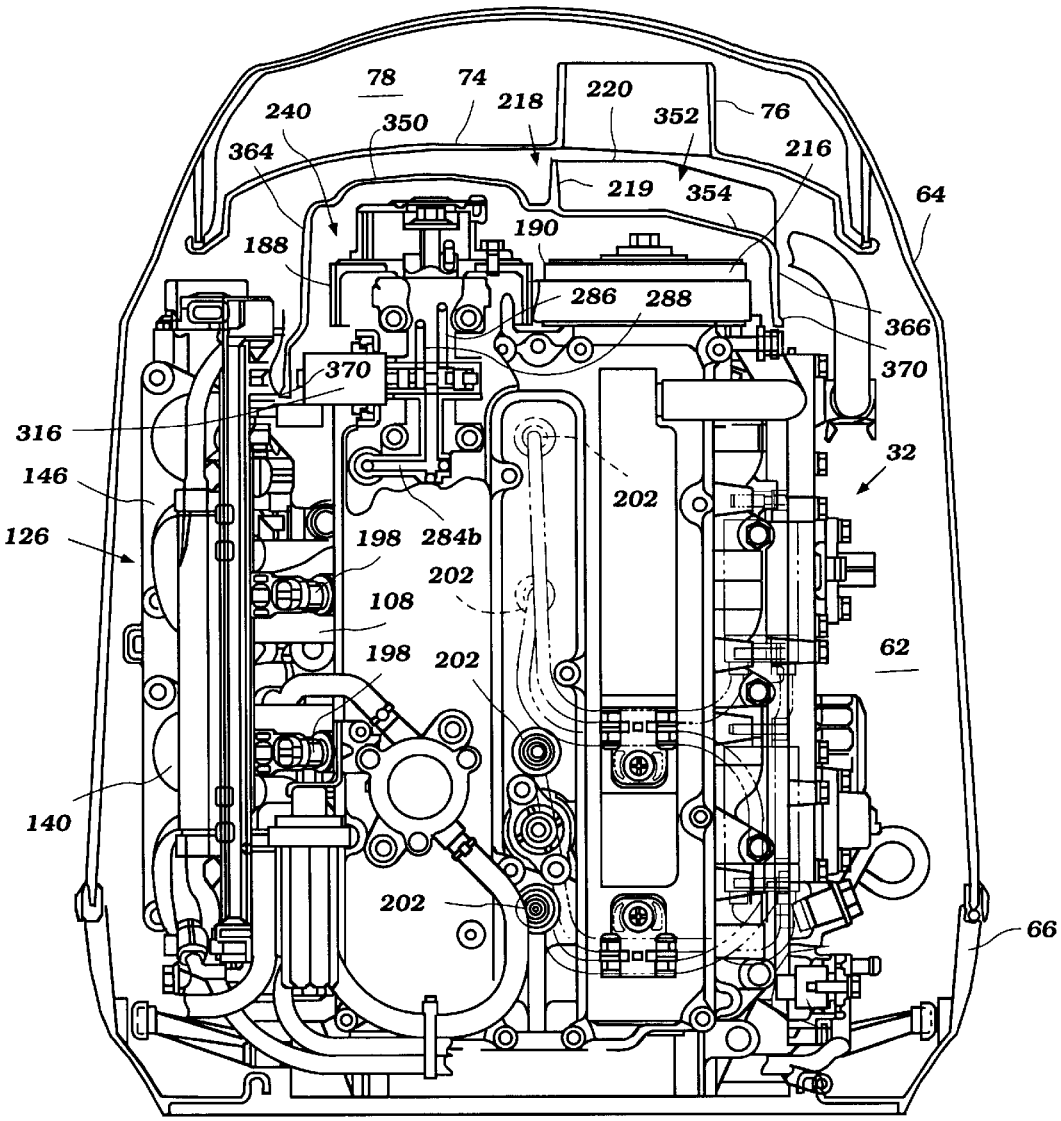
FIG. 5 is a rear view of the power head. The cowling assembly is shown in section taken along the line 5—5 of FIG. 2.

The top cowling member 64 preferably has a rear intake opening 72 on its rear and top portion. A rear intake member 74 with a rear air duct 76 is affixed to the top cowling member 64. A rear air intake space 78 is defined between the rear intake member 74 and the rear top portion of the top cowling member 64. As seen in FIG. 5, the rear air duct 74 is disposed toward the starboard side of the rear intake member 74.

Figure 2:
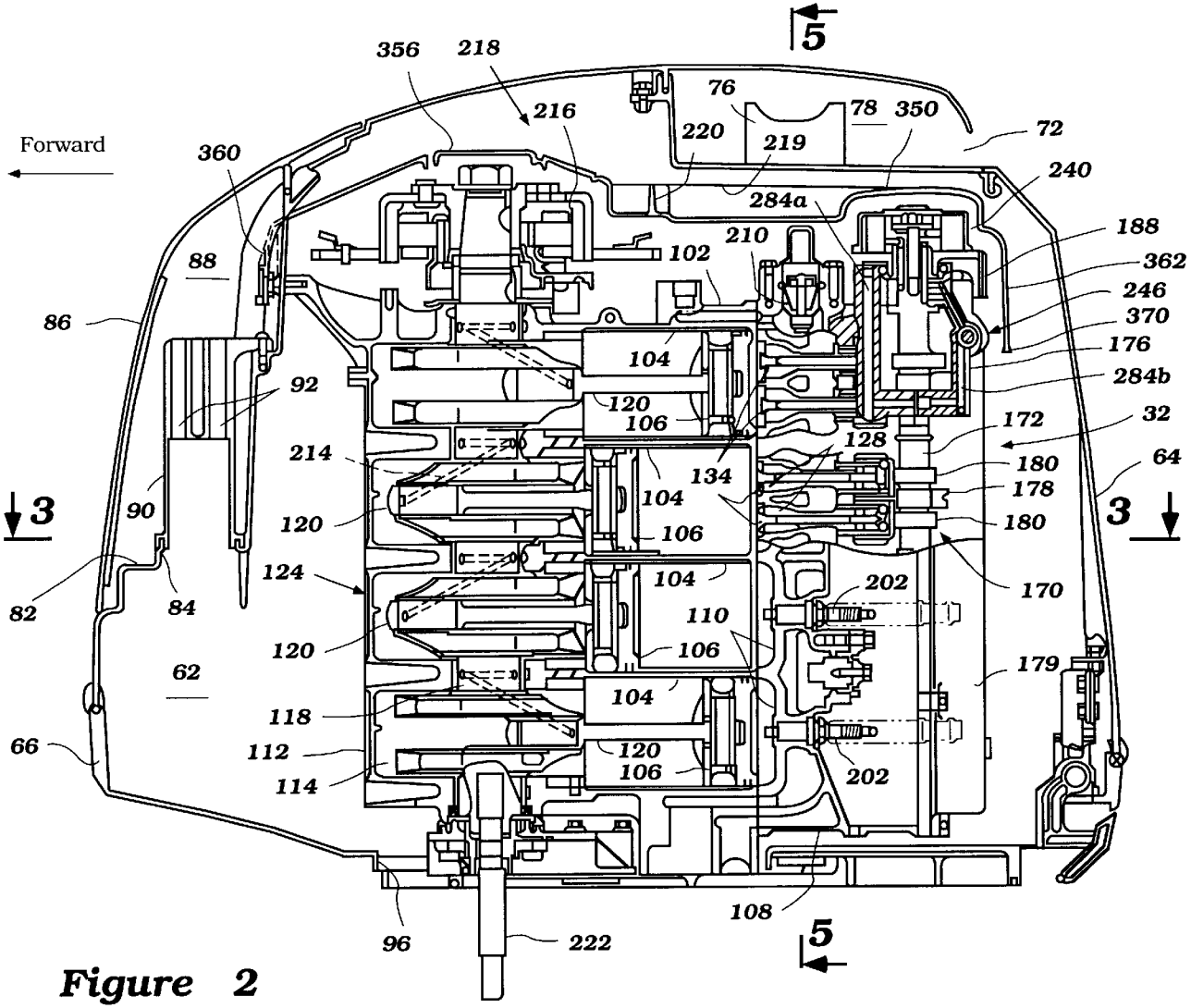
FIG. 2 is a sectional side view of a power head of the outboard motor. The side view is on the port side. An engine of the power head is also shown in section. A camshaft drive mechanism is omitted in this figure except for an intake driven sprocket.
Figure 3:
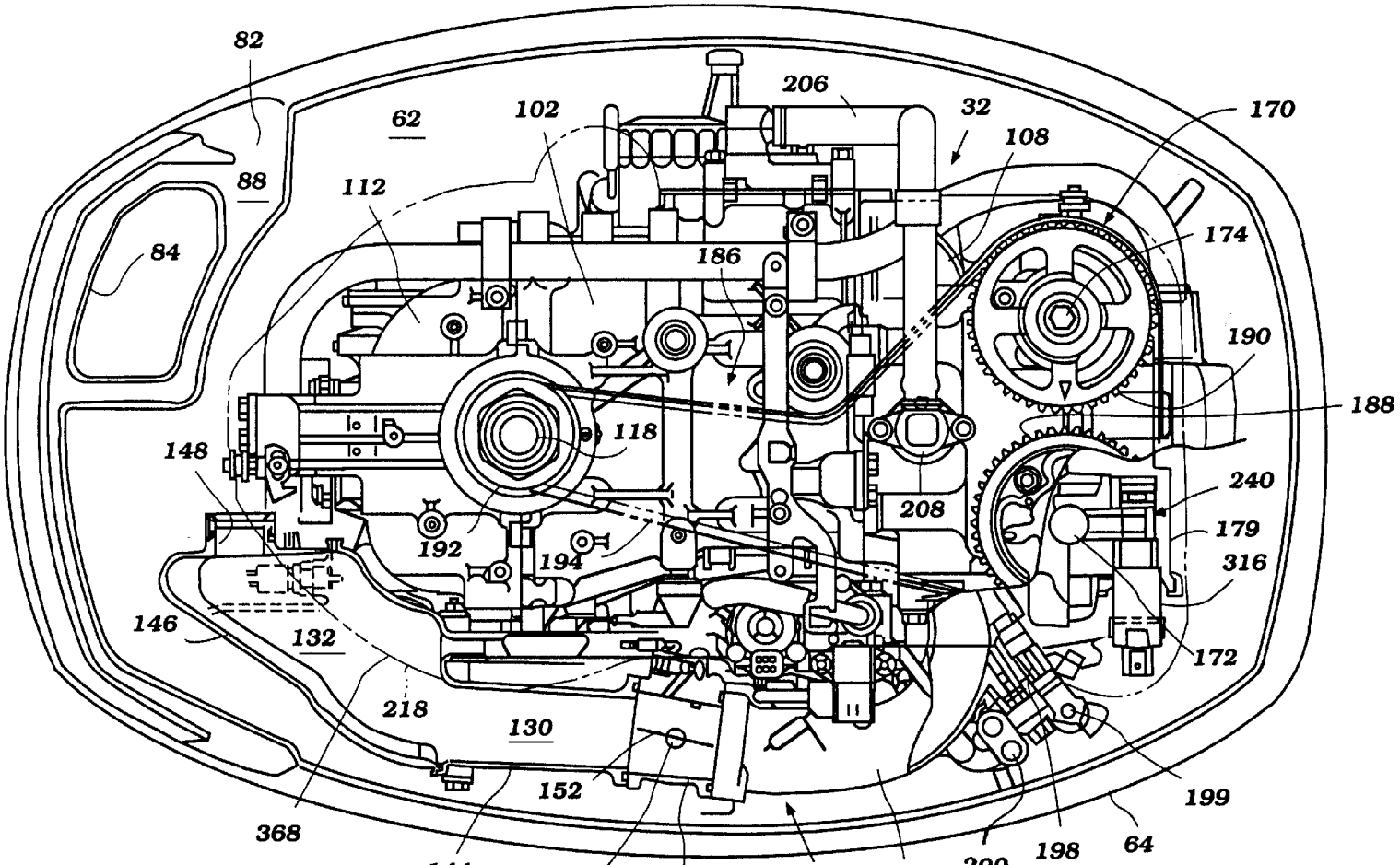
FIG. 3 is a top plan view of the power head. A cowling assembly is shown in section taken along the line 3—3 of FIG. 2. A protective cover is shown in phantom line.
Figure 4:
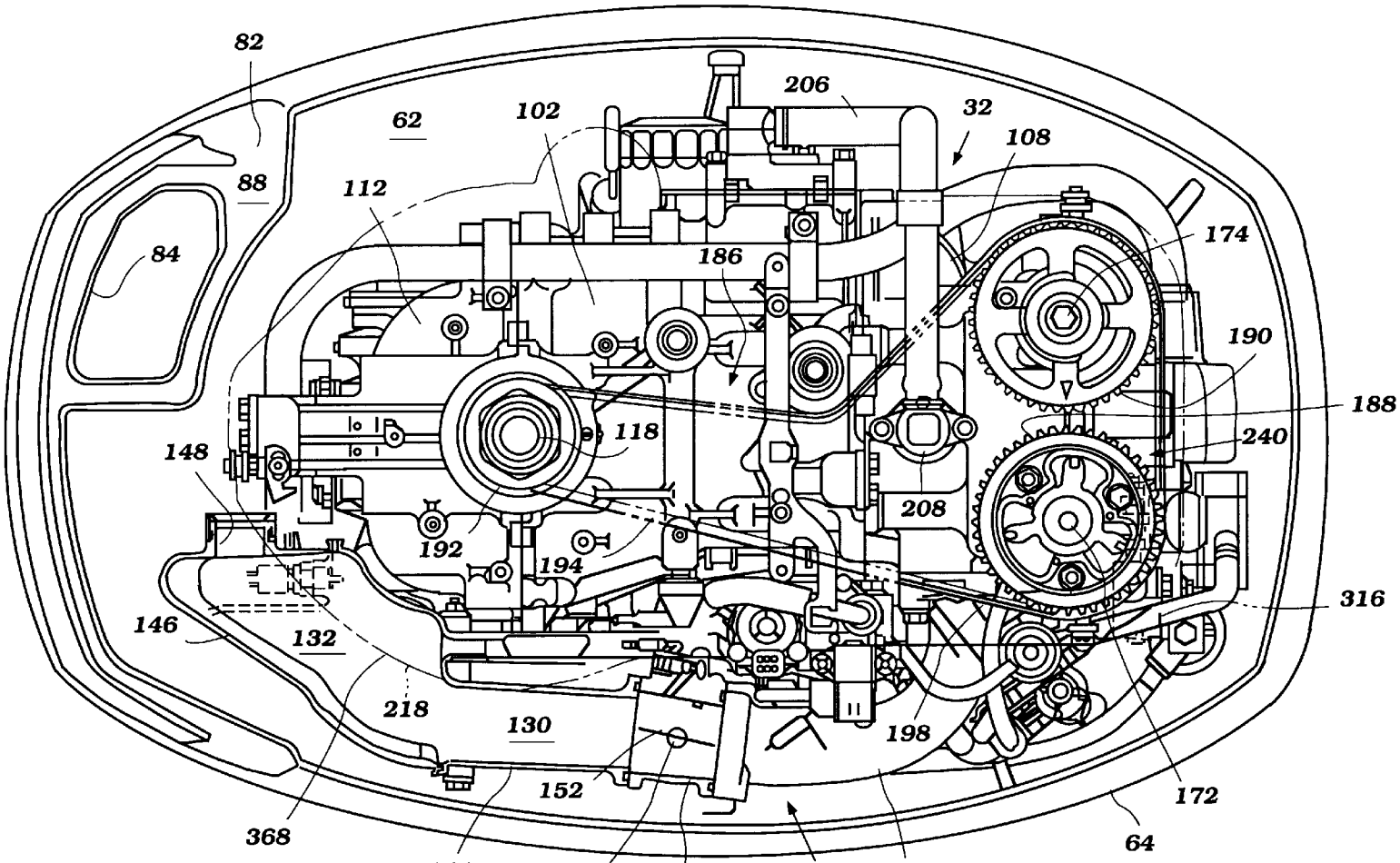
FIG. 4 is almost the same top plan view of the power head as that shown in FIG. 3.

With more specific reference to FIGS. 2–4, a recessed portion 82 is formed at a front end of the top cowling member 64. An opening 84 is defined at the recessed portion 82 and on the starboard side. An outer shell 86 covers the recessed portion 82 to define a front air intake space 88. A front air duct 90 is affixed to the recessed portion 82 of the top cowling member 64 to be placed over the opening 84 and to communicate with the enclosed cavity 62. The air duct 90 has a plurality of apertures 92, each of which is circularly configured in section. A front intake opening is defined between the recessed portion 82 of the top cowling member 64 and the outer shell 86 so that the front intake space 88 communicates with the environment outside of the cowling assembly 60. Ambient air thus is drawn through the rear intake opening 72 or the front intake opening, further through the air ducts 76, 90 and into the enclosed cavity 62.

Typically, the top cowling member 64 tapers in girth toward its top surface, which is in the general proximity of the air intake opening 72.

The bottom cowling member 66 preferably has an opening 96 at its bottom portion through which an upper portion of an exhaust guide member 98 (FIG. 1) extends. The exhaust guide member 98 preferably is made of aluminum alloy and is affixed atop the driveshaft housing 54. The bottom cowling member 66 and the exhaust guide member 98 together generally form a tray. The engine 32 is placed onto this tray and is affixed to the exhaust guide member 98. The exhaust guide member 98 also has an exhaust passage through which burnt charges (e.g., exhaust gases) from the engine 32 are discharged.

The engine 32 in the illustrated embodiment operates on a four-cycle combustion principle. The engine 32 has a cylinder block 102. The presently preferred cylinder block 102 defines four cylinder bores 104 which extend generally horizontally and are generally vertically spaced from one another. As used in this description, the term "horizontally" means that the subject portions, members or components extend generally parallel to the water line 41 when the drive unit 34 is not tilted and is placed in the position shown in FIG. 1. The term "vertically" in turn means that portions, members or components extend generally normal to those that extend horizontally.

The illustrated engine merely exemplifies one type of engine on which various aspects and features of the present invention can be suitably used. Engines having other number of cylinders, having other cylinder arrangements, and operating on other combustion principles (e.g., crankcase compression two-stroke or rotary) also can employ various features, aspects and advantages of the present invention.

Continuing with reference to FIGS. 1–7, and with specific reference to FIG. 2, a piston 106 reciprocates in each cylinder bore 104 in a well-known manner. A cylinder head assembly 108 is affixed to one end of the cylinder block 102 for closing the cylinder bores 104. The cylinder head assembly 108 preferably defines four combustion chambers 110 together with the associated pistons 106 and cylinder bores 104. Of course, the number of combustion chambers can vary, as indicated above. A crankcase member 112 closes the other end of the cylinder bores 104 to define a crankcase chamber 114 together with the cylinder block 102. A crankshaft or output shaft 118 extends generally vertically through the crankcase chamber 114 and is journaled for rotation by several bearing blocks in a suitable arrangement. Connecting rods 120 couple the crankshaft 118 with the respective pistons 106 in a well-known manner. Thus, the crankshaft 118 can rotate with the reciprocal movement of the pistons 106.

Preferably, the crankcase member 112 is located at the most forward position, with the cylinder block 102 and the cylinder head member 108 extending rearward from the crankcase member 112, one after the other. Generally, the cylinder block 102, the cylinder head member 108 and the crankcase member 112 together define an engine body 124. Preferably, at least these major engine portions 102, 108, 112 are made of aluminum alloy. The aluminum alloy advantageously increases strength over cast iron while decreasing the weight of the engine body 96.

The engine 32 comprises an air induction system or device 126. The air induction system 126 draws air from the cavity 62 into the combustion chambers 110. The air induction system 126 preferably comprises eight intake ports 128 (FIGS. 2 and 6), four intake passages 130 and a single plenum chamber 132. In the plenum chamber 132 intake passages 130 and intake ports 128 are each oriented toward the left side of the engine.

Two intake ports 128 are allotted to one combustion chamber 110 and also to one intake passage 130. The intake ports 128 are defined in the cylinder head assembly 108. Intake valves 134 are slidably disposed at the cylinder head member 108 to move between an open position and a closed position of the intake ports 128. Normally, bias springs 136 (FIG. 7) urge the intake valves 134 toward the respective closed positions by retainers 138 that are affixed to the valves 134. When each intake valve 134 is in the open position, the intake passage 130 that is associated with the intake port 128 communicates with the associated combustion chamber 110.

As seen in FIGS. 3 and 4, each intake passage 130 preferably is defined with an intake manifold 140, a throttle body 142 and an intake runner 144. The intake manifold 140 and the throttle body 142 preferably are made of aluminum alloy, while the intake runner 144 is made of plastic. A portion of the intake runner 144 extends forwardly. The respective portions of the intake runners 144 define the plenum chamber 132 together with a plenum chamber member 146 that preferably is made of plastic.

The plenum chamber 132 has an air inlet 148 that opens into the cavity toward a front of the cavity 62. The air in the closed cavity 62 is drawn into the plenum chamber 132 through the air inlet 148 and is coordinated therein before flowing through the respective intake passages 130. The plenum chamber 132 acts also as an intake silencer.

Figure 6:
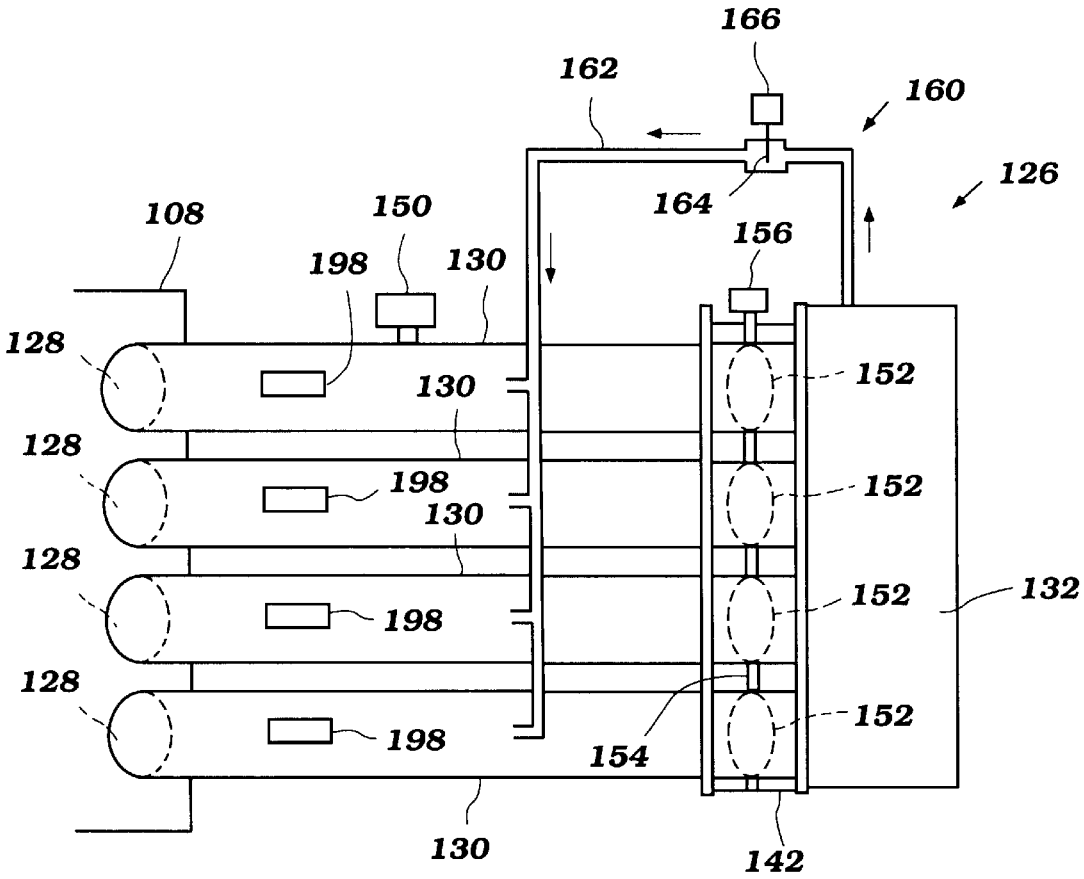
FIG. 6 is a schematic view of an air intake system employed for the engine.

In the illustrated embodiment, as seen in FIG. 6, the intake passage 130, i.e., the intake manifold 140 or the intake runner 144, that lies atop of four passages 130 has an intake pressure sensor 150 to sense a pressure in the associated intake passage 130. Because the respective intake passages 130 are each substantially the same size, and the plenum chamber 132 coordinates the air before delivering it to the intake passages 130, every passage 130 has substantially equal pressure and a signal of the pressure sensor 150 thus can represent a condition of the respective pressure.

Each throttle body 142 has a throttle valve 152 journaled for pivotal movement about an axis of a valve shaft 154 that extends generally vertically. The valve shaft 154 links the entire valves 152 to move them simultaneously. The valve shaft 154 is operable by the operator through an appropriate conventional throttle valve linkage. The throttle valves 152 are movable between an open position and a closed position to measure or regulate an amount of air flowing through the respective air intake passages 130. Normally, the greater the opening degree, the higher the rate of airflow and the higher the engine speed.

In order to bring the engine 32 to idle speed and to retain idle speed, the throttle valves 152 are almost closed but preferably not completely closed to ensure a stable idle speed and to prevent adhesion of the throttle valves 152. As used through the description, the term "idle speed" means an engine speed that is when the throttle valves 152 are closed but includes a state such that the valves 152 are slightly open to allow a quite small amount of air to flow. A throttle position sensor 156 (FIG. 6) preferably is disposed atop the valve shaft 154 to sense a position between the open and closed positions of the throttle valves 152.

As seen in FIG. 6, the air induction system 126 preferably includes an idle air delivery device or idle speed control (ISC) mechanism 160 that bypasses the throttle valves 152 and extends from the plenum chamber 132 to the respective intake passages 130. Idle air thus is delivered to the combustion chambers 110 through the idle air delivery device 160 and the rest of the intake passages 130 when the throttle valves 152 are substantially placed in the closed position. The idle air delivery device 160 preferably comprises an idle air passage 162, an idle valve 164 and an idle valve actuator 166. The idle air passage 162 is branched off to the respective intake passages 130. The idle valve 164 preferably is a needle valve that can move between an open position and a closed position of the idle passage 162. The idle valve actuator 166 actuates the idle valve 164 to a certain position to measure or adjust an amount of the idle air.

The engine 32 also includes an exhaust system that routes burnt charges, i.e., exhaust gases, to a location outside of the outboard motor 30. Each cylinder bore 104 preferably has two exhaust ports defined in the cylinder head member 108. The exhaust ports are selectively opened and closed by exhaust valves. A structure of each exhaust valve and an arrangement of the exhaust valves substantially are the same as the intake valve and the arrangement thereof, respectively. An exhaust manifold preferably is formed next to the exhaust ports and extends generally vertically. The exhaust manifold communicates with the combustion chambers 110 through the exhaust ports to collect exhaust gases therefrom. The exhaust manifold is coupled with the foregoing exhaust passage of the exhaust guide member 98. When the exhaust ports are opened, the combustion chambers 110 thus communicate with the exhaust passage through the exhaust manifold.

Figure 7:
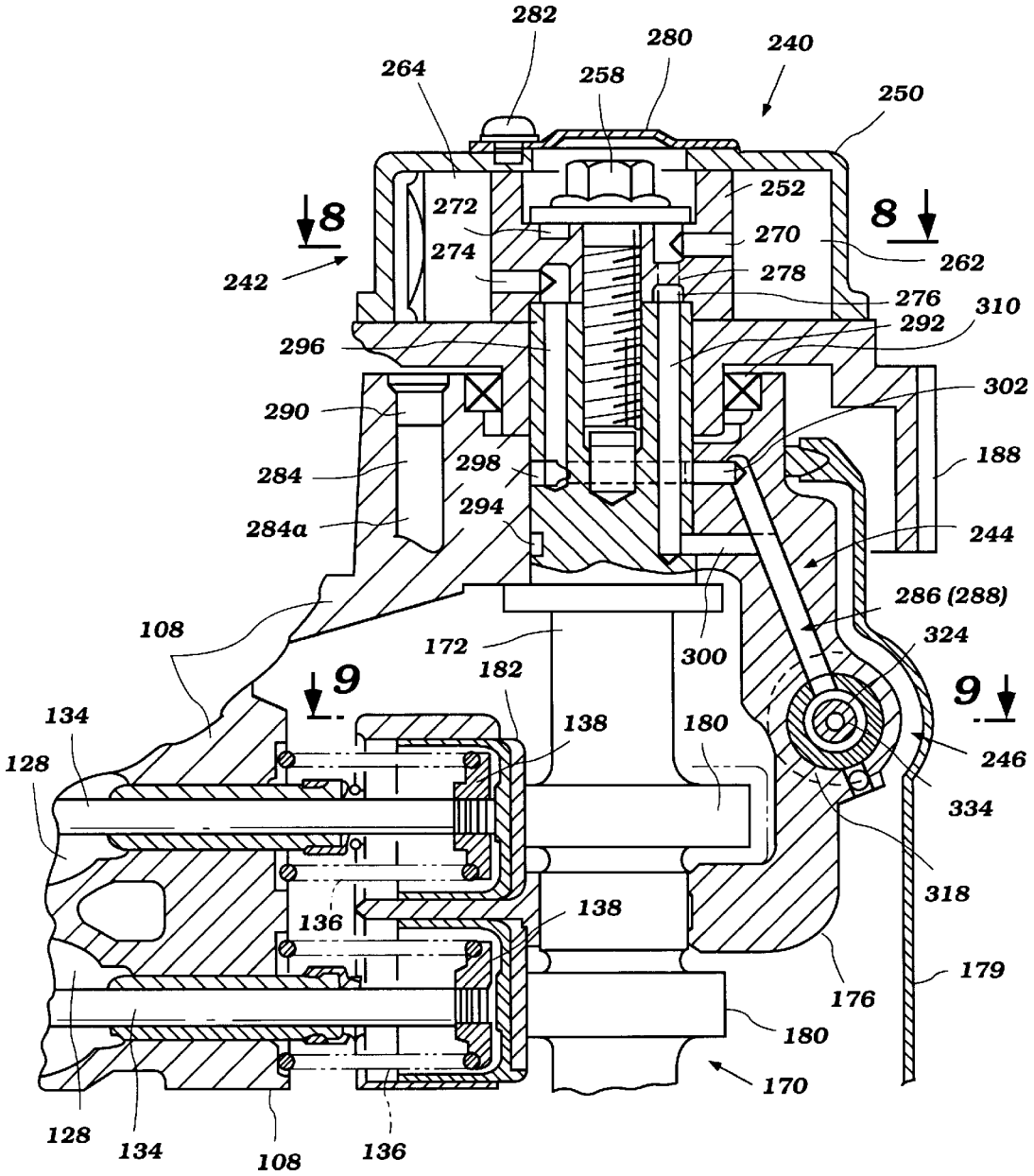
FIG. 7 is an enlarged, sectional side view of the engine showing a variable valve timing (VVT) mechanism.

A valve cam mechanism or valve actuator 170 preferably is provided for actuating the intake valves 134 and the exhaust valves. In the illustrated embodiment, the valve cam mechanism 170 includes an intake camshaft 172 and an exhaust camshaft 174 both extending generally vertically and journaled for rotation by the cylinder head member 108 and bearing caps 176, 178 (FIG. 2). A camshaft cover 179 is affixed to the cylinder head member 108 to cover the camshafts 172, 174. Each camshaft 172, 174, as best seen in FIG. 7, has cam lobes 180 to push valve lifters 182 that are affixed to the respective ends of the intake valves 134 and exhaust valves as in a known manner. The cam lobes 180 repeatedly push the valve lifters 182 at timing in proportion to the engine speed with the rotation of the camshafts 172, 174 to actuate the intake valves 134 and the exhaust valves.

A camshaft drive mechanism 186 (FIGS. 3 and 4) is provided for driving the valve cam mechanism 170. As best seen in FIG. 3, while the intake camshaft 172 and the exhaust camshaft 174 have an intake driven sprocket 188 positioned atop the intake camshaft 172 and an exhaust driven sprocket 190 positioned atop the exhaust camshaft 174, respectively, the crankshaft 118 has a drive sprocket 192 positioned almost atop thereof. A timing chain or belt 194 is wound around the driven sprockets 188, 190 and the drive sprocket 192. The crankshaft 118 thus drives the respective camshafts 172, 174 through the timing chain 194 in the timed relationship. Because the camshafts 172, 174 must rotate at half of the speed of the rotation of the crankshaft 118 in the four-cycle combustion principle, a diameter of the driven sprockets 188, 190 is twice as large as a diameter of the drive sprocket 192.

The engine 32 preferably has a port or manifold fuel injection system. The fuel injection system preferably comprises four fuel injectors 198, with one fuel injector allotted for each of the respective combustion chambers 110 through suitable fuel conduits 199. The fuel injectors 198 are mounted on a fuel rail 200 which is mounted on the cylinder head member 108. The fuel rail 199 also defines a portion of the fuel conduits 199. Each fuel injector 198 preferably has an injection nozzle directed toward the associated intake passage 130 adjacent to the intake ports 134. The fuel injectors 198 spray fuel into the intake passages 130 under control of an electronic control unit (ECU) that is mounted on the engine body 124 at an appropriate location. The ECU controls initiate timing and duration of fuel injection so that the fuel injector nozzles spray a proper amount of the fuel per combustion cycle. Of course, the fuel injectors 198 can be disposed for direct cylinder injection, carburetors can replace or accompany the fuel injectors 198.

The engine 32 further comprises an ignition or firing system. Each combustion chamber 110 is provided with a spark plug 202 that is connected to the ECU through an igniter so that ignition timing is also controlled by the ECU. Each spark plug 202 has electrodes that are exposed into the associated combustion chamber and are spaced apart from each other with a small gap. The spark plugs 202, with the structure, make a spark between the electrodes to ignite an air/fuel charge in the combustion chamber 110 at selected ignition timing under control of the ECU.

In the illustrated engine 32, the pistons 106 reciprocate between top dead center and bottom dead center. When the crankshaft 118 makes two rotations, the pistons 106 generally move from top dead center to bottom dead center (the intake stroke), from bottom dead center to top dead center (the compression stroke), from top dead center to bottom dead center (the power stroke) and from bottom dead center to top dead center (the exhaust stroke). During the four strokes of the pistons 106, the camshafts 172, 174 make one rotation and actuate the intake valves 134 and the exhaust valves so that the intake ports 128 are opened during the intake stroke and the exhaust ports are opened during the exhaust stroke.

Generally, during the intake stroke, air is drawn into the combustion chambers 110 through the air intake passages 130 and fuel is injected into the intake passages 130 by the fuel injectors 198. The air and the fuel thus are mixed to form the air/fuel charge in the combustion chambers 110. Slightly before or during the power stroke, the respective spark plugs 202 ignite the compressed air/fuel charge in the respective combustion chambers 110. The air/fuel charge thus furiously burns during the power stroke to reciprocate the pistons 106. The burnt charges, i.e., exhaust gases, then are discharged from the combustion chambers 110 during the exhaust stroke.

During engine operation, heat builds in the engine body 124. The engine 32 thus includes a cooling system to cool the engine body 124. The outboard motor 30 preferably employs an open-loop type water cooling system that introduces cooling water from the body of water surrounding the motor 30 and then discharges the water back to the water body. The cooling system includes one or more water jackets defined within the engine body 124 through which the introduced water runs to remove heat from the engine body 124. A water discharge pipe 206 (FIGS. 3 and 4) conveys discharge water from the waterjackets away from the engine body 124. A thermostat chamber 208 is defined at a location where the discharge pipe 206 is connected to the engine body 124 and encloses a thermostat 210 (FIG. 2) that controls flow of the discharge water. When the water temperature is relatively low immediately after the engine 32 is started, the thermostat 210 closes so as to inhibit the water from flowing out of the engine. Thus, the flow of cooling water is temporarily stopped immediately after engine startup so that the engine 32 can be warmed up quickly. A temperature at which the thermostat opens preferably is set as about 50–60° C.

The engine 32 preferably includes a lubrication system. Although many types of lubrication systems can be applied, a closed-loop type system is employed in the illustrated embodiment. The lubrication system comprises a lubricant tank defining a reservoir cavity preferably positioned within the driveshaft housing 54. An oil pump is provided at a desired location, such as atop the driveshaft housing 54, to pressurize the lubricant oil in the reservoir cavity and to pass the lubricant oil through a suction pipe toward engine portions, which are lubricated, through lubricant delivery passages. The engine portions that need lubrication include, for example, the crankshaft bearings, the connecting rods 120 and the pistons 106. For example, portions 214 of the delivery passages (FIG. 2) are defined in the crankshaft 118. Lubricant return passages also are provided to return the oil to the lubricant tank for re-circulation.

A flywheel assembly 216 preferably is positioned atop the crankshaft 118 and is mounted for rotation with the crankshaft 118. The flywheel assembly 216 comprises a flywheel magneto or AC generator that supplies electric power to various electrical components such as the fuel injection system, the ignition system and the ECU.

A protective cover 218, which preferably is made of plastic, extends over the major top portion of the engine 32 to cover the portion including the flywheel assembly 216 and the camshaft drive mechanism 186. As seen in FIG. 2, a bottom portion, at least in part, of the protective cover 218 is left open. Radiation of heat from the engine thus is enabled.

The protective cover 218 preferably has a transverse rib 220 (FIGS. 2 and 5) that extends upwardly from the cover 218 and inhibits air that has entered the enclosed space 62 through the air duct 76 from flowing directly over the cover toward the front of the engine. As shown in FIG. 2, the rib 220 is positioned forwardly of the air duct 76. A longitudinal rib 219 (FIGS. 2 and 5) also extends upwardly from the cover and inhibits air from the air duct 76 from flowing directly toward the port side of the engine, where the air induction system 126 is located. As shown in FIG. 5, rib 219 preferably is positioned toward the port side relative to the air duct 76.

The ribs 219, 220 are preferably substantially perpendicular to each other, with rib 219 being elongate and generally positioned to run in a fore/aft direction and rib 220 being generally normal to rib 219. The ribs 219, 220 advantageously help airflow move around the engine body 124 to cool the engine body 124. More specifically, much of the intake air from the air duct 76 is directed to the starboard (exhaust) side of the engine 32, and flows over the engine toward the plenum chamber air inlet 148, which is located toward the front and port sides of the engine 32.

The ribs 219, 220 also help define a tortuous airflow path that helps remove water that may be entrained in intake air. The removed water collects on the cover 218 and is directed by the ribs 219, 220 toward the starboard (exhaust) side of the motor, and away from engine components that may be particularly sensitive to water contact. Thus, the rib arrangement helps protect certain engine components from intrusion of water thereon.

The driveshaft housing 54 depends from the power head 50 to support a driveshaft 222 which is coupled with the crankshaft 118 and extends generally vertically through the driveshaft housing 54. The driveshaft 222 is journaled for rotation and is driven by the crankshaft 118. The driveshaft housing 54 preferably defines an internal section of the exhaust system that directs the majority of exhaust gases to the lower unit 56. An idle discharge section is branched off from the internal section so that when the engine 13 is at idle speed, idle exhaust gases are discharged directly to the atmosphere through a discharge port that is formed on a rear surface of the driveshaft housing 54. The driveshaft 222 preferably drives the oil pump.

The lower unit 56 depends from the driveshaft housing 54 and supports a propulsion shaft 226 (FIG. 1) that is driven by the driveshaft 222. The propulsion shaft 226 extends generally horizontally through the lower unit 56 and is journaled for rotation. A propulsion device is attached to the propulsion shaft 226. In the illustrated arrangement, the propulsion device is a propeller 228 that is affixed to an outer end of the propulsion shaft 226. The propulsion device, however, can take the form of a dual counter-rotating system, a hydrodynamic jet, or any of a number of other suitable propulsion devices.

A transmission 232 preferably is provided between the driveshaft 222 and the propulsion shaft 226, which lie generally normal to each other (i.e., at a 90° shaft angle), to couple together the two shafts 222, 226 through bevel gears. The outboard motor 30 has a clutch mechanism that allows the transmission 146 to change the rotational direction of the propeller 144 among forward, neutral or reverse.

The lower unit 56 also defines an internal section of the exhaust system that is contiguously connected with the internal section of the driveshaft housing 54. At engine speeds above idle, the exhaust gases generally are discharged to the body of water surrounding the outboard motor 30 through the internal sections and then a discharge section defined within the hub of the propeller 228. Incidentally, the exhaust system can include a catalytic device at any location in the exhaust system to purify the exhaust gases.

With continued reference to FIGS. 2–5 and 7, and additionally with reference to FIGS. 8 and 9, the variable valve timing (VVT) mechanism or setting mechanism 240 will now be described below.

The VVT mechanism 240 preferably is configured to set the intake camshaft 172 to an angular position that is between a first angular position and a second angular position with respect to the intake driven sprocket 188. At the first angular position, the intake camshaft 172 opens and closes the intake valves 134 at the most advanced timing. At the second angular position, the intake camshaft 172 opens and closes the intake valves 134 at the most delayed timing. Any angular position between both the first and second angular position is delayed with respect to the first angular position and is advanced with respect to the second angular position.

The VVT mechanism 240 preferably is hydraulically operated. As best seen in FIG. 7, the illustrated VVT mechanism 240 comprises a setting section 242, a fluid supply section 244 and a control section 246. As will be explained in more detail below, the setting section 242 sets the intake camshaft 172 at a certain angular position with respect to the intake driven sprocket 188 in response to a rate of working fluid flow that is allotted to each of two spaces of the setting section 242. The fluid supply section 244 preferably supplies the working fluid to the setting section 242. Preferably, the working fluid is a portion of the lubricant from the lubrication system. Of course in some arrangements, a separate hydraulic circuit can be formed. The control section 246 selects the amount of the working fluid allotted to each of the two spaces and preferably is under the control of the ECU.

Figure 8:
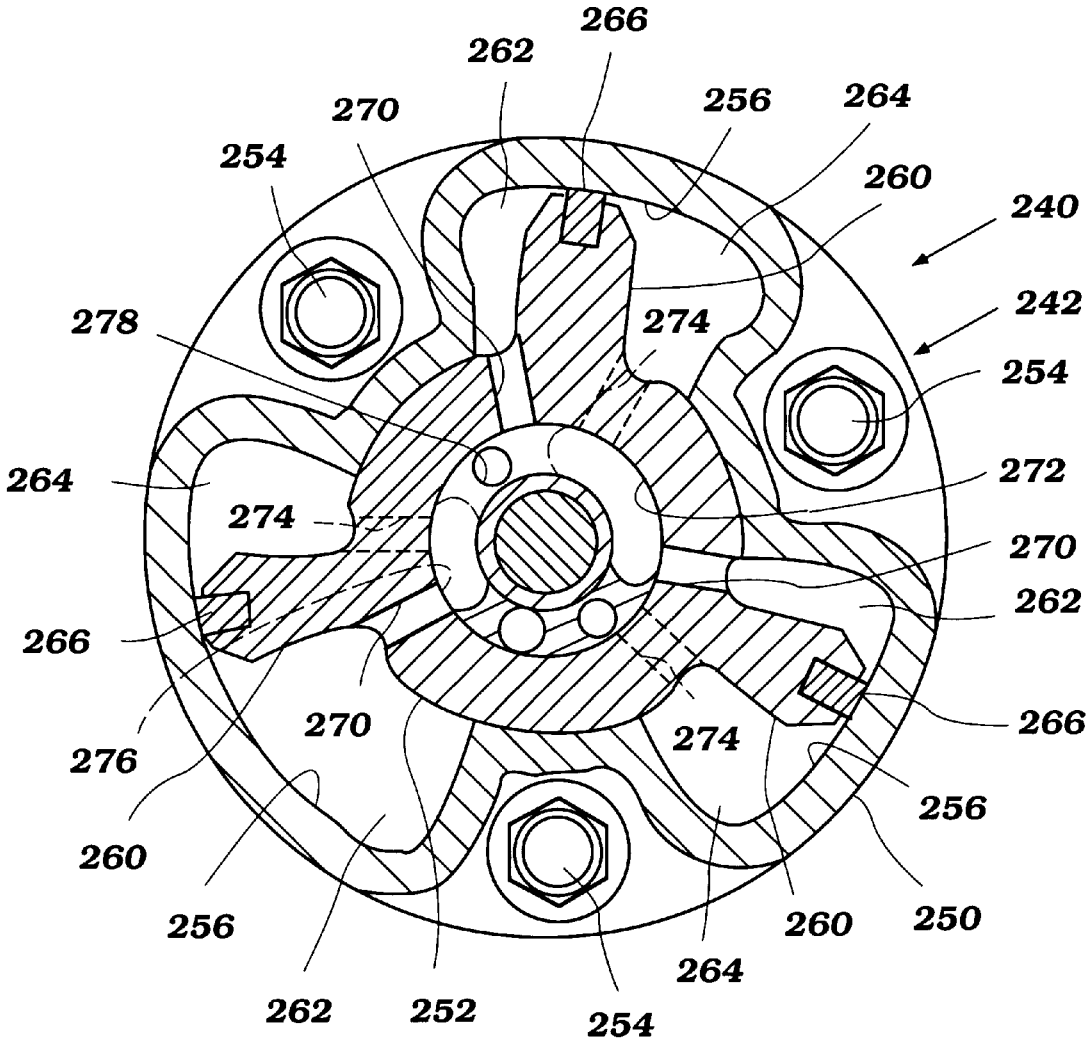
FIG. 8 is a sectional view of the VVT mechanism taken along the line 8—8 FIG. 7.

With particular reference to FIGS. 7 and 8, the setting mechanism 242 preferably includes an outer housing 250 and an inner rotor 252. The illustrated outer housing 250 is affixed to the intake driven sprocket 188 by three bolts 254 and preferably forms at least one chamber 256 and more preferably three chambers 256, which can be positioned between the three bolts 254. The inner rotor 252 is affixed atop of the intake camshaft 172 by a bolt 258 and preferably has at least one vane 260 pivotably placed within each of the respective chambers 256 of the housing 250. In the illustrated arrangement, the inner rotor 252 has three vanes 260 that extend radially and are spaced apart from each other by angle of approximately 120 degrees. The sides of each vane 260 divide the respective chambers 256 such that define a first space 262 and a second space 264. Seal members 266 preferably are carried by the respective vanes 260 and abut on an inner surface of the housing 250 so as to substantially separate the first and second spaces 262, 264 from each other.

The respective first spaces 262 communicate with one another through respective pathways 270 and a ditch 272 that is formed around the bolt 258, while the respective second spaces 264 communicate with one another through respective pathways 274 and a ditch 276 that is also formed around the bolt 258. The ditches 272, 276 in the illustrated arrangement generally are configured as a substantially circular flow path around the bolt and are axially offset from one another. A pathway 278 extends from the ditch 272 to a bottom portion of the rotor 252. A cover member 280 is affixed to the outer housing 250 by screws 282 to cover the bolt 258.

Figure 9:
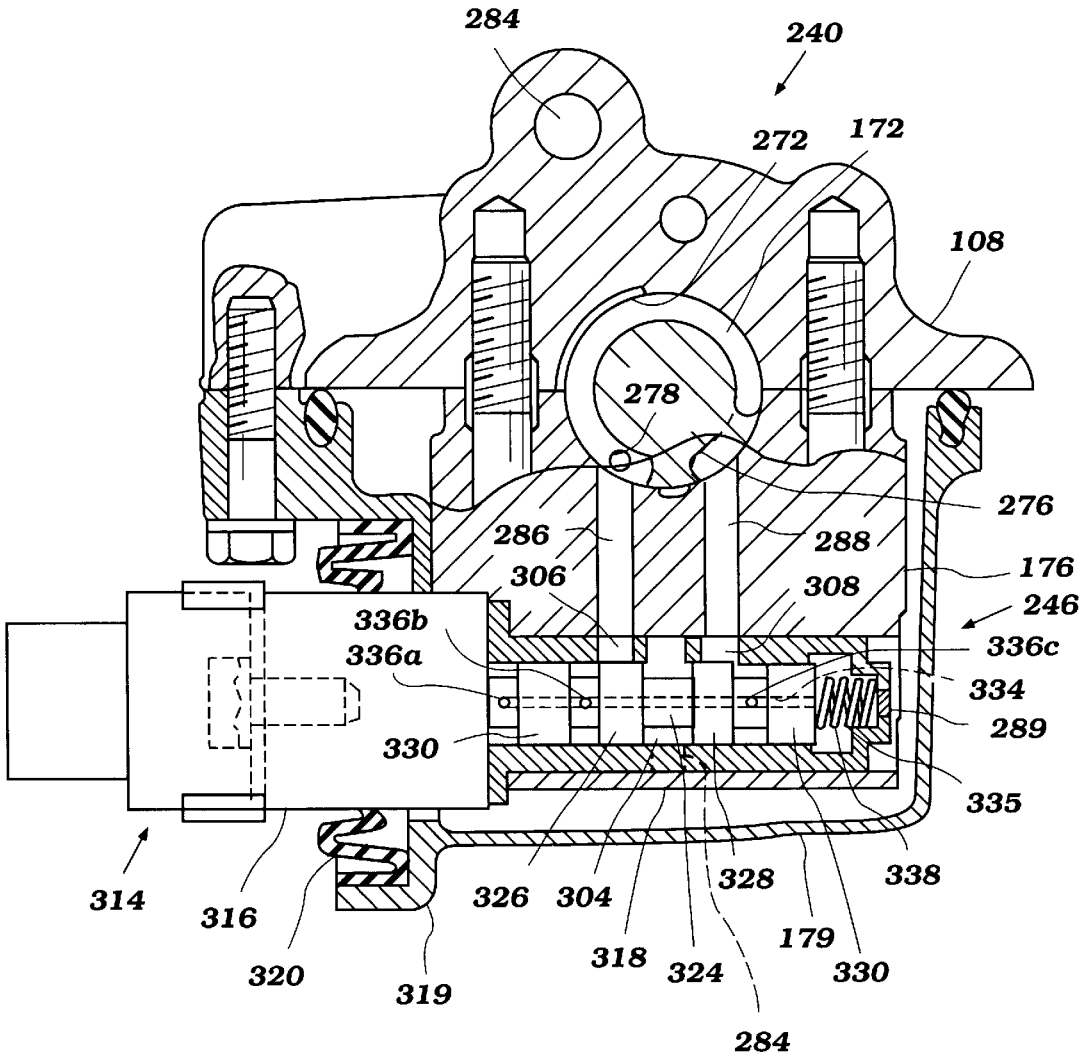
FIG. 9 is a sectional view of the VVT mechanism taken along the line 9—9 of FIG. 7.

With particular reference to FIGS. 7 and 9, the fluid supply section 244 preferably includes a supply passage 284 (see also FIG. 2) and a first and second passages 286, 288. The supply passage 284 and the first and second passages 286, 288 communicate with one another through the control section 246. The supply passage 284 preferably has a passage portion 284*a* (FIG. 5) defined in the cylinder head assembly 108 and a passage portion 284*b* (FIG. 2) defined in the bearing cap 176.

In some embodiments, the supply passage 284 communicates with the lubrication system so that a portion of the lubricant oil is supplied to this VVT mechanism 240. Because the passage portion 284*a* is formed by a drilling process in the illustrated embodiment, a closure member 290 closes one end of the passage portion 284*a*.

The first and second passages 286, 288 preferably are defined within a top portion of the camshaft 172 and the bearing cap 176. A portion of the first passage 286 includes a pathway 292 that is formed in the camshaft 172. The pathway 292 extends vertically and communicates with the pathway 278 that communicates with the ditch 272 of the first space 262. The pathway 292 also communicates with a ditch 294 that is formed in the camshaft 172. A pathway 300 is formed in the bearing cap 176. One end of pathway 300 communicates with the ditch 294, while another end of the pathway 300 communicates through port 306 with a common chamber 304 as formed in the control section 246.

A portion of the second passage 288 includes a pathway 296 that is formed in the camshaft 172. The pathway 296 extends generally vertically and communicates with the ditch 276 of the second space 264. The pathway 296 also communicates with a ditch 298 that is formed in the camshaft 172. A pathway 302 is formed in the bearing cap 176. One end of the pathway 302 communicates with the ditch 298, and another end of the pathway communicates through a port 308 with the common chamber 304.

A seal member 310 is inserted between the cylinder head assembly 108, the camshaft 172 and the bearing cap 176 to inhibit the lubricant from leaking out. It should be noted that FIGS. 7 and 9 show the delivery passages 286, 288 in a schematic fashion and that the passages 286, 288 preferably do not actually merge together.

The control section 246 preferably includes an oil control valve (OCV) 314. The OCV 314 comprises a housing section 316 and a cylinder section 318. Both the housing and cylinder sections 316, 318 preferably are positioned in the upper bearing cap 176. The sections 316, 318 preferably also extend through a hole of the camshaft cover 179. The camshaft cover preferably 179 includes a lip 319 around the opening. A bellow 320, preferably made of rubber, is provided between the housing section 316 and the lip 319 of the camshaft cover 179 to close and seal the through-hole.

The cylinder section 318 defines the common chamber 304 that communicates the supply passage 284 and the first and second delivery passages 286, 288. The cylinder section preferably includes a drain 289 that, in the illustrated arrangement, is open to the interior of the camshaft cover 179, although in other arrangements the drain 289 can be connected to other portions of the lubrication system. The housing section 316 preferably encloses a solenoid type actuator, although other types of actuators can also be used.

A rod 324 extends into the common chamber 304 from the housing 316 and is axially movable therein. The illustrated rod 324 has a first valve 326 and a second valve 328 and a pair of guide portions 330. The valves 326, 328 and the guide portions 330 have an outer diameter that is larger than an outer diameter of the rod 324 and approximately equal to an inner diameter of the cylinder 318. The rod 324 defines an internal passage 334, which extends through the rod 324, and apertures 336a, 336b, 336c, which communicate with the passage 334 and the common chamber 304 to allow the lubricant to escape through the drain 289 through an opening 335 as will be explained in more detail below. A coil spring 338 is retained at an end of the cylinder 318 opposite to the housing section 316 to urge the rod 324 toward the solenoid.

The solenoid actuates the rod 324 under control of the ECU so that the rod 324 can take several axial positions in the chamber 304. More specifically, the solenoid is configured to preferably push the rod 324 step by step toward certain positions as the ECU commands. If the desired position is closer to the solenoid than the present position, then the solenoid does not have to actuate the rod 324 and the coil spring 338 can push the rod 324 back to the desired position.

To direct lubricant to the first space 262, the rod 324 is moved to the left of the position shown in FIG. 9. In this position, the first passage 286 is in communication with the supply passage 284 while the second valve 328 substantially isolates the second passage 288 from the supply passage 284. In this manner, lubricant can flow into the first space 262 while the lubricant in the second space 264 can escape to the drain 289. For example, in the illustrated arrangement, the lubricant in the second passage 288 can flow into the aperture 336*c* through passage 334 and to the drain 289. To direct lubricant to the second space 264, the rod 324 is moved to the right from the position shown in FIG. 9. In this position, the second passage 288 is in communication with the supply passage 284 while the first valve 326 substantially isolates the first passage 286 from the supply passage 284. In this manner, lubricant can flow into the second space 264 while the lubricant in the first space 262 can escape through the drain 289. That is, the lubricant in the first passage 286 can flow into the aperture 336b and through passage 334 into the drain 289.

In the manner described above, the degree to which the inlet ports 306, 308 are closed or opened determines the amount of the lubricant that is allotted to the first and second passages 286, 288 and to the first and second spaces 262, 264 in the setting section 242 described above. The amount of the lubricant supplied to the first and second spaces 262, 264 thus determines an angular position of the camshaft 172 with respect to the intake driven sprocket 188. If more lubricant is allotted to the first space 262 than to the second space 264, the camshaft 172 is set closer to the most advanced position, and vise versa.

The operation of the illustrated VVT mechanism 240 will now be described in more detail. When the engine 32 is running, the rotation of the crankshaft 118 is transmitted to the exhaust camshaft 174 through the exhaust driven sprocket 190 and the timing chain 194. In a similar manner, the rotation of the crankshaft is also transmitted to the intake camshaft 172 through the timing chain 194, intake driven sprocket 188 and the VVT mechanism 240. Preferably, the intake and exhaust camshafts 172, 174 rotate at a predetermined speed (e.g., one half of the speed of the crankshaft 118).

As mentioned above, the outer housing 250 of the VVT mechanism 240 is coupled to and thus rotated by the intake driven sprocket 188. The rotation of outer housing 250 is transmitted to the inner rotor 252 through the lubricant in the chambers 256 of the housing 250. The inner rotor 252, in turn, is affixed to atop the intake camshaft 172 such that the rotation of the inner rotor 252 is transmitted to the intake camshaft 172. When the intake camshaft 172 is rotated, the intake valves 134 are opened and closed at an appropriate timing by the intake cams 180 formed in the intake camshaft 172. Therefore, by selectively supplying lubricant to the first and second spaces 262, 264 inside the VVT mechanism 240, the phase of the intake camshaft 172 with respect to the intake driven sprocket 188 can be adjusted and, thus, the timing of the opening and closing of the intake valves 134 can be controlled.

The control section 246 selectively supplies and removes lubricant to/from the first and second spaces 262, 264 as described above. Lubricant is supplied from the lubricant pump or an additional pump to the common chamber 304 of the control section 246 through the lubricant passages 284. From the common chamber 304, the lubricant is selectively supplied to the delivery passages 286, 288, by alternately opening and closing or by partially blocking the inlet ports 306, 308 with the rod 324 of the OCV 314. As mentioned above, the ECU controls the movement of the rod 324.

When the lubricant is supplied to the first delivery passage 286, lubricant is supplied to the first space 262 through the lubricant passages 292, 278, 270, lubricant is removed from the second space 264 and the inner rotor 252 rotates to the clockwise direction relative to the outer housing 250 as shown in FIG. 8. When lubricant is supplied to the second delivery passage 288, lubricant is supplied to the second space 264 through the lubricant passages 298, 296 274 and lubricant is removed from the first space as described above. The inner rotor 252 rotates relative to the outer housing 250 in the counterclockwise direction as shown in FIG. 6. As such, the phase of the intake camshaft 172 which rotates together with the inner rotor 252 can be adjusted and the opening-and-closing timing of the intake valves 134 can be advanced or delayed.

An advantage of the illustrated arrangement is that the since the OCV 314 is generally positioned along a substantially horizontal axis, which in the illustrated arrangement, is also generally perpendicular to the intake camshaft 172. This arrangement is advantageous for several reasons. For example, the lubricant in the lubricant system may have vapors (i.e., bubbles) mixed into the lubricant. As mentioned above, if the OCV 314 is positioned along a substantially vertical axis, these vapors can tend to rise and can be preferentially directed to one of the two supply passages 286, 288. This can alter the amount of lubricant that is supplied to the first and second spaces 262, 264, which in turn, can cause inaccuracies in the phase angle of the inner rotor 252 with respect to the outer housing 250 and the timing of the opening and closing of the intake valves 134. By arranging the common chamber and such that the inlet ports 306, 308 are located substantially at the same elevation, the lubricant supplied to the first and second spaces 262, 264 is more consistent as the vapors are not preferentially directed to either the first or the second passages 286, 288.

Another advantage of the illustrated arrangement is that, in the illustrated arrangement, the OCV 314 is positioned near the upper end of the intake camshaft 172. More preferably, the OCV 314 is positioned in the upper bearing cap 176, which supports the intake camshaft 172 and, in the illustrated arrangement, the exhaust cam shaft 174. This position reduces the distance between the OCV 314 and the setting section 242, which is located atop the intake cam shaft 172. As such, the length of the various lubricant passages, which preferably are also located in the upper bearing cap 176, of the fluid supply section 244 can be reduced. The shortened distances increases the responsiveness of the VVT 240 to the position changes of the OCV 314.

Another advantage of the illustrated arrangement is that the OCV 314 positioned generally along an axis that extends across the engine 32 from the right side to the left side. This provides for a compact size of the engine 32.

In the illustrated embodiment, the VVT mechanism 240 is formed on the intake camshaft and is not formed on the exhaust camshaft. It should be understood, however, that a VVT mechanism 240 can also be formed on the exhaust camshaft, so that both the intake and exhaust camshafts have a VVT mechanism.

As discussed above, the protective cover 218 extends over the major top portion of the engine 32 to cover the flywheel assembly 26 and the camshaft drive mechanism 186. With reference again to FIGS. 2–4 and 5, the cover 218 is preferably shaped to roughly correspond to the engine components that it covers.

In the illustrated embodiment, the VVT mechanism 240 is arranged on the upper end of the intake camshaft 172. Thus, an upwardly-extending portion 350 is formed in the cover 218. This portion 350 is positioned adjacent to and is shaped to roughly correspond to the VVT mechanism 240. A space is maintained between the VVT mechanism and the cover 218 so that the cover does not interfere with operation of the VVT mechanism 240.

Since a VVT mechanism is provided only for the intake camshaft 172 in the illustrated embodiment, the upwardly-extending portion 350 is located toward the port (intake) side of the motor 30. The area 352 of the cover toward the starboard (exhaust) side of the upwardly-extending portion 350 is generally flat, and has an inclined portion 354, which directs water that may be on the cover toward the exhaust side of the motor 30. It is to be understood that, in another-embodiment, the entire area 352 can be inclined toward the starboard side, and can have a constant or varying slope.

A second upwardly-extending portion 356 is formed in the cover 218 adjacent to and roughly corresponding to the flywheel assembly 216.

The cover 218 has a front wall 360, back wall 362, port wall 364 and starboard wall 366 that collectively define the perimeter 368 of the cover 218. Each wall extends downwardly and terminates in an edge 370, which extends about the perimeter. However, the downwardly-extending distance of portions of the walls varies. For example, with reference next to FIG. 2, the front wall 360 extends downwardly a distance enough to generally shield the flywheel assembly 216 along its side. The port wall 364 and starboard wall 366 extend downwardly about the same distance in the area adjacent to the flywheel assembly's upwardly-extending portion 352.

With next reference to FIG. 5, in the area of the cover 218 adjacent to the exhaust camshaft 174, the starboard wall 366 extends downwardly a distance so that the edge 370 is positioned substantially at or below a lower portion of the exhaust driven sprocket 190.

With particular reference next to FIGS. 2 and 5, the port wall 364 and back wall 362 in the area adjacent the VVT mechanism 240 extend downwardly a distance so that the edge 370 is positioned sustantially at or below the position of the OCV 314. In this manner, substantially all of the VVT mechanism 240, including the setting section 242, fluid supply section 244 and control section 246 is shielded along the side by the walls 362, 364. In the illustrated embodiment, this portion of the cover 218 extends downwardly farther than other portions of the cover.

The illustrated engine cover 218 protects the VVT mechanism 240 from contact with water, which contact could lead to corrosion. The ribs 219, 220 help to direct intake air toward the exhaust side of the motor and away from the VVT mechanism 240. The upwardly-extending portion 350 also directs air away from the VVT mechanism 240. Thus, water that may be entrained in the intake air will not impinge upon the VVT mechanism. Additionally, the downwardly-extending walls 362, 364 protect the VVT mechanism from water that may become deposited on and flow across the cover 218, because the walls extend downwardly enough to shield the VVT mechanism from such water.

The illustrated embodiment shows a VVT mechanism 240 provided only for the intake camshaft 172. It is to be understood that in embodiments employing a VVT mechanism for the exhaust camshaft 174, another upwardly-extending portion of the cover 218 could roughly correspond to the exhaust VVT mechanism, and the starboard and rear walls 366, 362 could extend downwardly so as to substantially completely shield the exhaust VVT mechanism along its side.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising a cowling having an air intake duct configured to introduce air into the cowling from the environment outside of the cowling, a four-cycle internal combustion engine positioned within the cowling and adapted to drive a substantially vertically oriented crankshaft, the engine comprising, a combustion chamber, an induction system configured to supply intake air to the combustion chamber, and an exhaust system configured to conduct combustion products away from the combustion chamber, the induction system arranged generally on one of a first side of the engine and a second side of the engine, and the exhaust system arranged generally on the other of the first side and second side of the engine, a camshaft driven by the crankshaft, a variable valve timing mechanism cooperating with the camshaft and positioned at an upper end of the camshaft, an engine cover positioned between an upper end of the engine and the air intake duct, the engine cover having a first upwardly-extending rib positioned between the air intake duct and the first side of the engine, a second upwardly-extending rib positioned between the air intake and a front side of the engine, and an upwardly-extending portion positioned generally above the variable valve timing mechanism, the ribs and upwardly-extending portion configured to direct air from the air intake duct toward the second side of the engine and away from the variable valve timing mechanism, wherein the air intake duct is positioned offset toward the second side of the engine and generally forwardly of the upwardly-extending portion of the engine cover.

2. An outboard motor as in claim 1, wherein a portion of the cover extends downwardly generally around an outer portion of the variable valve timing mechanism.

3. An outboard motor as in claim 2, wherein a lower edge of the downwardly-extending portion of the cover generally adjacent the variable valve timing mechanism is positioned generally lower than a bottom edge of the variable valve timing mechanism.

4. An outboard motor as in claim 3, wherein the camshaft comprises an intake camshaft.

5. An outboard motor comprising a cowling having an air intake duct configured to introduce air into the cowling from the environment outside of the cowling, a four-cycle internal combustion engine positioned within the cowling and adapted to drive a substantially vertically oriented crankshaft, a camshaft arranged generally parallel to the crankshaft, a variable valve timing (VVT) mechanism configured to selectively vary a phase angle of the camshaft, the VVT mechanism arranged adjacent an upper end of the camshaft and comprising a setting section, a fluid supply section, and a control section, a cover arranged between the engine and the air intake, the cover comprising a top portion and a side wall depending from the top portion and having a lower edge, wherein the top portion covers the VVT mechanism and a portion of the side wall adjacent the VVT mechanism is configured so that the lower edge is at or below a lowermost portion of the VVT mechanism.

6. An outboard motor as in claim 5, wherein an upwardly-extending portion of the cover top portion adjacent an upper portion of the VVT mechanism is shaped to roughly approximate the shape of the VVT mechanism upper portion.

7. An outboard motor as in claim 5, wherein the engine has a front end, a rear end, a first side and a second side, and the cover has a first upwardly-extending rib arranged between the air intake and the first side.

8. An outboard motor as in claim 7, wherein the cover has a second upwardly-extending rib positioned between the air intake and the front end.

9. An outboard motor as in claim 7, wherein the air intake is offset toward the second side of the engine.

10. An outboard motor as in claim 9, wherein at least a portion of the cover that is positioned toward the second side of the engine from first rib slopes downwardly.

11. An outboard motor as in claim 9, wherein the air intake is positioned forwardly of the VVT mechanism.

12. An outboard motor as in claim 11, wherein the cover comprises an upwardly-extending portion adjacent the VVT mechanism.

13. An outboard motor as in claim 12, wherein the upwardly-extending portion of the cover cooperates with the first rib.

14. An outboard motor comprising a cowling having an air intake duct configured to introduce air into the cowling from the environment outside of the cowling, a four-cycle internal combustion engine positioned within the cowling and adapted to drive a substantially vertically oriented crankshaft, a camshaft arranged generally parallel to the crankshaft and driven by the crankshaft, a variable valve timing (VVT) mechanism configured to selectively vary a phase angle of the camshaft, the VVT mechanism arranged adjacent an upper end of the camshaft, and a cover arranged between the engine and the air intake, the cover comprising a top portion and a side wall depending from the top portion, wherein the air intake duct is positioned on an opposite side of a longitudinal center line of the cowling from the VVT mechanism.

15. An outboard motor as in claim 14, wherein the cover comprises an upwardly-extending portion adjacent the VVT mechanism and generally corresponding to the shape of an upper portion of the VVT mechanism, and the upwardly-extending portion is configured to direct air flowing through the air intake duct away from the VVT mechanism.

16. An outboard motor as in claim 15, wherein at least a portion of the engine cover slopes downwardly away from the VVT mechanism.

* * * * *